US011352822B2

(12) United States Patent
Brown et al.

(10) Patent No.: US 11,352,822 B2
(45) Date of Patent: Jun. 7, 2022

(54) SYSTEMS AND METHODS FOR SEALING A COMPARTMENT

(71) Applicant: The Boeing Company, Chicago, IL (US)

(72) Inventors: Douglas A. Brown, Chicago, IL (US); James P. Schalla, Chicago, IL (US); Justin W. Balvanz, Chicago, IL (US); Thomas J. Moran, Chicago, IL (US)

(73) Assignee: The Boeing Company, Chicago, IL (US)

( * ) Notice: Subject to any disclaimer, the term of this patent is extended or adjusted under 35 U.S.C. 154(b) by 287 days.

(21) Appl. No.: 16/424,979

(22) Filed: May 29, 2019

(65) Prior Publication Data

US 2020/0378167 A1 Dec. 3, 2020

(51) Int. Cl.
*E05F 1/06* (2006.01)
*E06B 7/22* (2006.01)

(52) U.S. Cl.
CPC ..... *E05F 1/063* (2013.01); *E05F 1/061* (2013.01); *E05F 1/066* (2013.01); *E06B 7/22* (2013.01); *E05Y 2900/132* (2013.01)

(58) Field of Classification Search
CPC ... E05F 1/063; E05F 1/61; E05F 1/066; E05F 1/061; E06B 7/22; E05Y 2900/132
See application file for complete search history.

(56) References Cited

U.S. PATENT DOCUMENTS 61,798 A * 2/1867 Bitner et al. ..... E05F 1/063 16/318
1,028,874 A * 6/1912 Gronek ..... E05F 1/063 16/312
1,034,008 A * 7/1912 Frey ..... E05F 1/063 16/318
1,039,216 A * 9/1912 Toms ..... E05F 1/063 16/318
2,904,824 A * 9/1959 Kuehl ..... E05F 1/063 16/318

(Continued)

FOREIGN PATENT DOCUMENTS

DE 1708313 A1 * 5/1971 ..... E05F 1/063
DE 202015002880 U1 * 6/2015 ..... E05F 1/063

(Continued)

OTHER PUBLICATIONS

Machine translation of FR319386.*

*Primary Examiner* — Marcus Menezes
(74) *Attorney, Agent, or Firm* — McDonnell Boehnen Hulbert & Berghoff LLP

(57) ABSTRACT

The present disclosure provides a system for sealing a compartment. The system includes a door with a seal positioned on a bottom surface of the door. The system also includes one or more hinges coupled to the door. The door rotates from a closed position to an open position via the one or more hinges. A height of the door with respect to a floor surface increases in response to a rotation of the door from the closed position to the open position due to a helical slope of both a first cam surface of the one or more hinges and a second cam surface of the one or more hinges. The seal transitions from a compressed state to a relaxed state in response to the rotation of the door from the closed position to the open position.

20 Claims, 10 Drawing Sheets

(56) References Cited

U.S. PATENT DOCUMENTS

| | | | | | |
|---|---|---|---|---|---|
| 3,098,258 | A * | 7/1963 | Ruiz | E05F 1/1223 | 16/50 |
| 3,401,422 | A * | 9/1968 | Ventura | E05F 1/061 | 16/54 |
| 5,371,987 | A * | 12/1994 | Hirsch | E06B 1/045 | 49/239 |
| 7,013,531 | B2 * | 3/2006 | Jackson | E05F 1/063 | 16/309 |
| 8,556,330 | B2 * | 10/2013 | Lazarevich | E05F 1/1223 | 296/146.11 |
| 2002/0116788 | A1 * | 8/2002 | Pompei | E05F 1/063 | 16/315 |
| 2004/0244293 | A1 * | 12/2004 | Eckel | E05D 15/54 | 49/334 |
| 2005/0011046 | A1 * | 1/2005 | Dionysian | E05F 1/063 | 16/316 |
| 2007/0000087 | A1 * | 1/2007 | Hour | E05F 1/063 | 16/50 |

FOREIGN PATENT DOCUMENTS

| | | | | |
|---|---|---|---|---|
| DE | 202018103378 U1 * | 9/2019 | E05F 1/1223 | |
| FR | 319386 A * | 11/1902 | E05F 1/063 | |
| FR | 387154 A * | 7/1908 | E05F 1/063 | |
| FR | 779650 A * | 4/1935 | E05F 1/063 | |

* cited by examiner

SYSTEMS AND METHODS FOR SEALING A COMPARTMENT

FIELD

The present disclosure relates generally to a system for sealing a compartment, and more particularly, to a system to lift a seal positioned on a bottom surface of a door when the door is opened to prevent the seal from dragging along the floor surface when the door is opened.

BACKGROUND

Aircraft galley cart compartments are often refrigerated to keep the contents therein cold. Traditional galley doors in such refrigerated sections use seals to keep the compartment cold. To maximize the internal volume of the compartment, the doors extend to the floor, and the seal is positioned along the bottom surface of the door and contacts the floor. Existing seals on traditional galley doors may be more accurately described as close-outs. Such seals are typically "whisker brush" devices that allow air flow thru the whiskers and additionally are not fully sealed against the floor due to their inability to flex and conform to the floor. Further, such a seal is prone to wear and tear as the door is opened and closed as such actions cause the seal to drag along the floor. Eventually the seal is replaced during maintenance as it becomes worn. Prior to replacement, a worn seal may enable cooled air to leak from the enclosed galley cart compartment, causing the airplane environmental control systems to work harder than necessary to maintain the appropriate temperature. As such, a need exists for a seal system for the bottom surface of the galley door that has an extended life and improved thermal sealing characteristics.

SUMMARY

In one aspect, the present disclosure provides a system for sealing a compartment. The system includes (a) a door having a top surface, a bottom surface opposite the top surface, a first side surface, and a second side surface opposite the first side surface, (b) a seal positioned on the bottom surface of the door, and (c) one or more hinges coupled to the door. Each of the one or more hinges comprises (i) a first plate coupled to the first side surface of the door, (ii) a second plate configured to be coupled to a stationary component adjacent the first side surface of the door such that the first plate is configured to rotate with respect to the second plate as the door rotates from a closed position to an open position, (iii) a first knuckle coupled to the first plate, wherein the first knuckle includes a first through-hole, and wherein the first knuckle includes a first cam surface having a helical slope greater than zero, (iv) a second knuckle coupled to the second plate, wherein the second knuckle includes a second through-hole, and wherein the second knuckle includes a second cam surface, and wherein the second cam surface of the second knuckle is configured to contact the first cam surface of the first knuckle, and (v) a pin positioned through the first through-hole of the first knuckle and the second through-hole of the second knuckle to thereby rotatably couple the first knuckle to the second knuckle. A height of the door with respect to a floor surface increases in response to a rotation of the door from the closed position to the open position due to the helical slope of the first cam surface and the second cam surface, and the seal transitions from a compressed state to a relaxed state in response to the rotation of the door from the closed position to the open position.

In another aspect, the present disclosure provides hinge. The hinge includes (a) a first plate, (b) a second plate configured to rotate with respect to the first plate as the hinge rotates from a closed position to an open position, (c) a first knuckle coupled to the first plate, wherein the first knuckle includes a first through-hole, and wherein the first knuckle includes a first cam surface having a non-constant helical slope greater than zero, (d) a second knuckle coupled to the second plate, wherein the second knuckle includes a second through-hole, and wherein the second knuckle includes a second cam surface, and wherein the second cam surface of the second knuckle is configured to contact the first cam surface of the first knuckle, and (e) a pin positioned through the first through-hole of the first knuckle and the second through-hole of the second knuckle to thereby rotatably couple the first knuckle to the second knuckle, wherein a gap between the first cam surface and the second cam surface increases in response to a rotation of the hinge from the closed position to the open position due to the non-constant helical slope of the first cam surface and the second cam surface.

In yet another aspect, the present disclosure provides a method for sealing a compartment. The method includes coupling a first plate of a hinge to a first side surface of a door. The method also includes coupling a second plate of the hinge to a stationary component adjacent the first side surface of the door, wherein the hinge further includes (i) a first knuckle coupled to the first plate, wherein the first knuckle includes a first cam surface having a helical slope greater than zero, and (ii) a second knuckle coupled to the second plate, wherein the second knuckle includes a second cam surface, and wherein the second cam surface of the second knuckle is configured to contact the first cam surface of the first knuckle. The method also includes rotating, via the hinge, the door from an open position to a closed position, wherein a height of the door with respect to a floor surface decreases in response to the rotation of the door from the open position to the closed position due to the helical slope of the first cam surface and the second cam surface. The method also includes transitioning a seal positioned on a bottom surface of the door from a relaxed state to a compressed state in response to the rotation of the door from the open position to the closed position to thereby seal the compartment.

The features, functions, and advantages that have been discussed can be achieved independently in various examples or may be combined in yet other examples further details of which can be seen with reference to the following description and figures.

BRIEF DESCRIPTION OF THE FIGURES

The novel features believed characteristic of the illustrative examples are set forth in the appended claims. The illustrative examples, however, as well as a preferred mode of use, further objectives and descriptions thereof, will best be understood by reference to the following detailed description of an illustrative examples of the present disclosure when read in conjunction with the accompanying figures.

DETAILED DESCRIPTION

The examples described herein provide a system to assist in sealing a compartment, and methods of manufacturing and use thereof. More specifically, the example system described herein provides a compressive seal on a bottom surface of the door that improves the seal between the door and the floor. The system also includes one or more hinges that lift the seal when the door is opened to prevent the seal from dragging along the floor. As such, the system not only improves the seal between the door and the floor, the system also increases the shelf life of the seal by removing the wear and tear of a traditional whisker brush seal.

Various other features of the example device discussed above, as well as methods for manufacturing and using the example system and hinge, are also described hereinafter with reference to the accompanying figures. While the focus of the disclosure is sealing refrigerated aircraft galley cart compartments, the system, hinge, and methods described herein may be used to seal any compartment or room. Illustrative, non-exhaustive examples, which may or may not be claimed, of the subject matter according the present disclosure are provided below.

Figure 1:
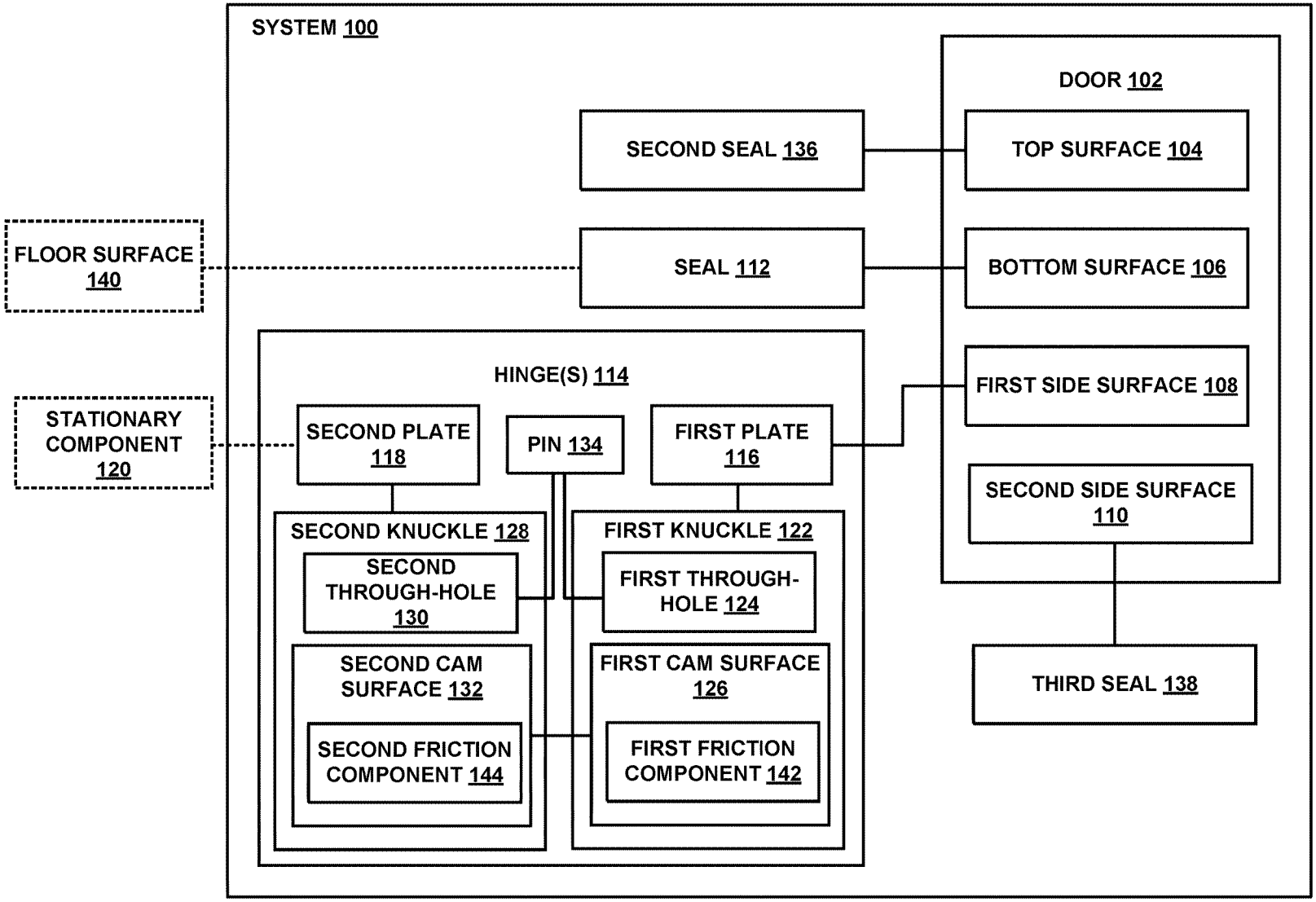
FIG. 1 is a block diagram of an example system.

With reference to the Figures, FIG. 1 illustrates an example configuration of a system 100 that may be used in connection with the implementations described herein.

As shown in FIG. 1, the system 100 includes a door 102 having a top surface 104, a bottom surface 106 opposite the top surface 104, a first side surface 108, and a second side surface 110 opposite the first side surface 108. The system 100 also includes a seal 112 positioned on the bottom surface 106 of the door 102. The system 100 also includes one or more hinges 114 coupled to the door 102.

In one example, the system 100 includes one of the hinge 114 coupled to the first side surface 108 of the door 102. In another example, the system 100 includes two hinges 114 coupled to the first side surface 108 of the door 102. In another example, the system 100 includes three hinges 114 coupled to the first side surface 108 of the door 102. In yet another example, the system 100 includes a plurality of hinges 114 extending an entire length of the first side surface 108 of the door 102. Other numbers of the hinge 114 are possible as well.

Each of the one or more hinges 114 includes a first plate 116 coupled to the first side surface 108 of the door 102, and a second plate 118 configured to be coupled to a stationary component 120 adjacent the first side surface 108 of the door 102. The stationary component 120 may be a wall or other component of the compartment 101 that the system 100 is configured to seal. The first plate 116 is configured to rotate with respect to the second plate 118 as the door 102 rotates from a closed position to an open position. Each of the one or more hinges 114 includes a first knuckle 122 coupled to the first plate 116. The first knuckle 122 includes a first through-hole 124, and the first knuckle 122 further includes a first cam surface 126 having a helical slope greater than zero. Each of the one or more hinges 114 includes a second knuckle 128 coupled to the second plate 118. The second knuckle 128 includes a second through-hole 130, and the second knuckle 128 further includes a second cam surface 132. In one example, the second cam surface 132 has the same helical slope as the first cam surface 126. The second cam surface 132 of the second knuckle 128 is configured to contact the first cam surface 126 of the first knuckle 122. Each of the one or more hinges 114 includes a pin 134 positioned through the first through-hole 124 of the first knuckle 122 and the second through-hole 130 of the second knuckle 128 to thereby rotatably couple the first knuckle 122 to the second knuckle 128.

In one example, a maximum rotation of the door 102 with respect to the stationary component 120 is about 270°. In another example, a maximum rotation of the door 102 with respect to the stationary component 120 is about 180°. In yet another example, a maximum rotation of the door 102 with respect to the stationary component 120 may range from between about 90° to about 180°, from between about 90° to about 270°, or from between about 180° to about 270°. Other maximum rotations of the door 102 with respect to the stationary component 120 are possible as well.

In one example, the seal 112 positioned on the bottom surface 106 of the door 102 comprises a first seal. In such an example, the system 100 may further include a second seal 136 positioned on the top surface 104 of the door 102, and a third seal 138 positioned on the second side surface 110 of the door 102. In one example, the seal 112 comprises the same material as the second seal 136 and the third seal 138. In another example, the seal 112 comprises a first material, while the second seal 136 and the third seal 138 comprise a second material that is different than the first material. The combination of the seal 112, the second seal 136, and the third seal 138 help to seal all sides of the compartment 101 when the door 102 is in the closed position. In addition to assisting in sealing the compartment 101, the second seal 136 and the third seal 138 may create a soft close feature of the door 102, thereby preventing the door 102 from slamming shut when in use.

Figure 2A:
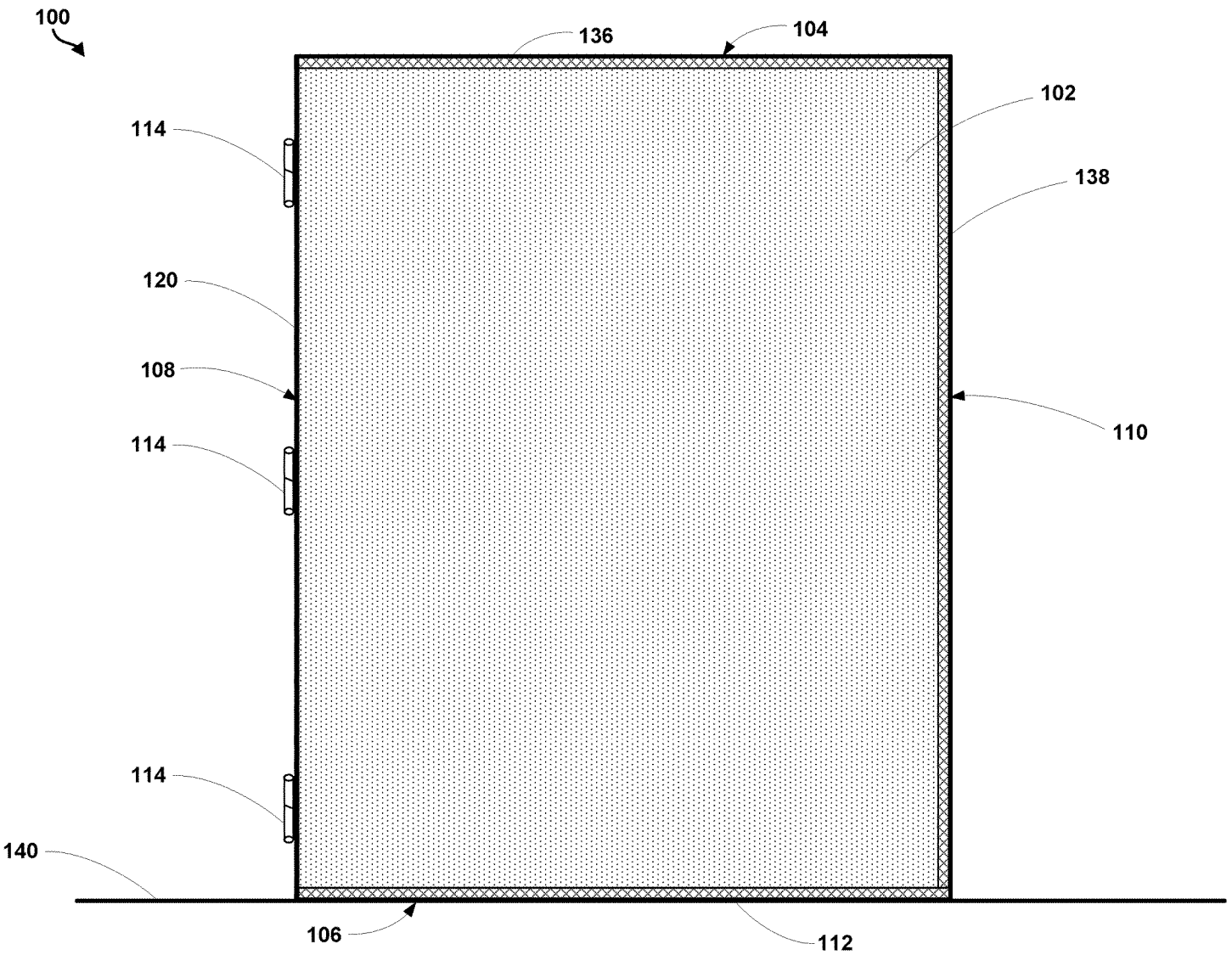
FIG. 2A illustrates an example system with the door in the closed position.
Figure 2B:
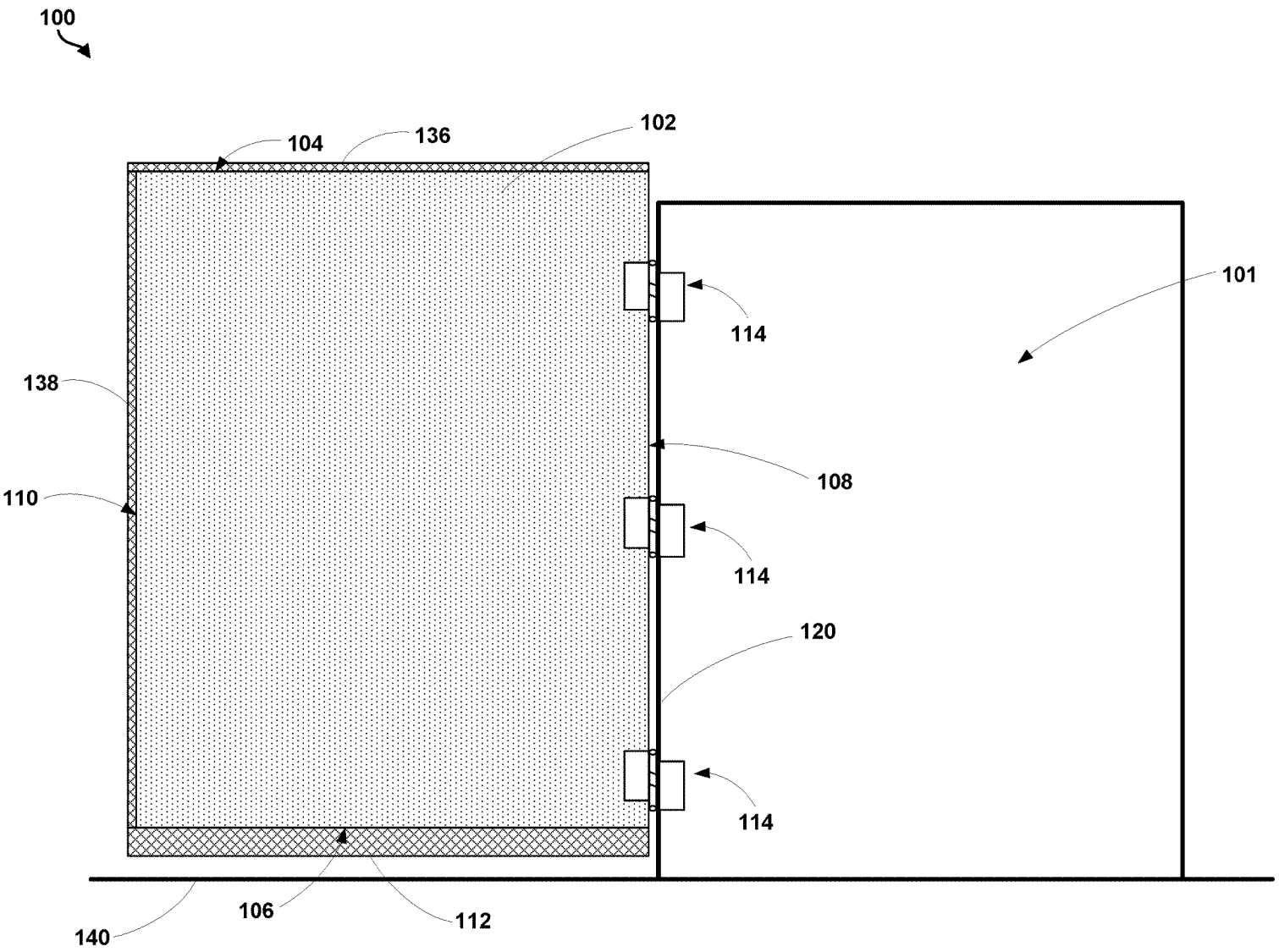
FIG. 2B illustrates the example system of FIG. 2A with the door in the open position.

FIG. 2A illustrates the door 102 in the closed position, and FIG. 2B illustrates the door in the open position. In use, as shown in FIGS. 2A-2B, a height of the door 102 with respect to a floor surface 140 increases in response to a rotation of the door 102 from the closed position to the open position due to the helical slope of the first cam surface 126 and the second cam surface 132. In particular, since the second knuckle 128 of the hinge is coupled to the second plate 118 of the hinge 114, which in turn is coupled to the stationary component 120, the second knuckle 128 is fixed vertically with respect to the first knuckle 122. As the helical slope of the first cam surface 126 contacts the helical slope of the second cam surface 132 during a rotation of the door 102 from the closed position to the open position, the complementary helical slopes of the hinge 114 causes the first knuckle 122 of the hinge 114 to move vertically with respect to the second knuckle 128 of the hinge 114. Since the first knuckle 122 is coupled to the first plate 116, which in turn is coupled to the door 102, the vertical movement of the first knuckle 122 with respect to the second knuckle 128 causes the height of the door 102 with respect to a floor surface 140 to increase. As shown in FIG. 2B, as the height of the door 102 with respect to a floor surface 140 increases, a gap 141 is created between the seal 112 and the floor surface 140. Such a gap 141 prevents the seal 112 from dragging along the floor surface 140 as the door 102 is opened and closed, thereby improving the seal between the door 102 and the floor surface 140 as well as increasing the shelf life of the seal 112.

In addition, as shown in FIGS. 2A-2B, the seal 112 transitions from a compressed state (shown in FIG. 2A) to a relaxed state (shown in FIG. 2B) in response to the rotation of the door 102 from the closed position to the open position. In one example, a height of the seal 112 is greater in the relaxed state than in the compressed state, as shown in FIG. 2B. The seal 112 may take a variety of forms. In one example, the seal 112 may comprise a compressible rubber material such as natural rubber, styrene-butadiene rubber (SBR), neoprene, ethylene propylene diene monomer (EPDM), nitrile, butyl, or silicone, as non-limiting examples. In another example, the seal 112 may comprise a foam material such as high density Expanded Polypropylene (EPP), Ethylene-Vinyl Acetate (EVA), or Polyethylene-Vinyl Acetate (PEVA), as non-limiting examples. The seal 112 may comprise a bulb seal, a foam seal, or any other compressive seal. The use of a compressive seal enables the door to use compressive force to conform the seal 112 to the shape of the floor surface 140, thereby providing an improved seal between the bottom surface 106 of the door 102 and the floor surface 140.

Figure 3A:
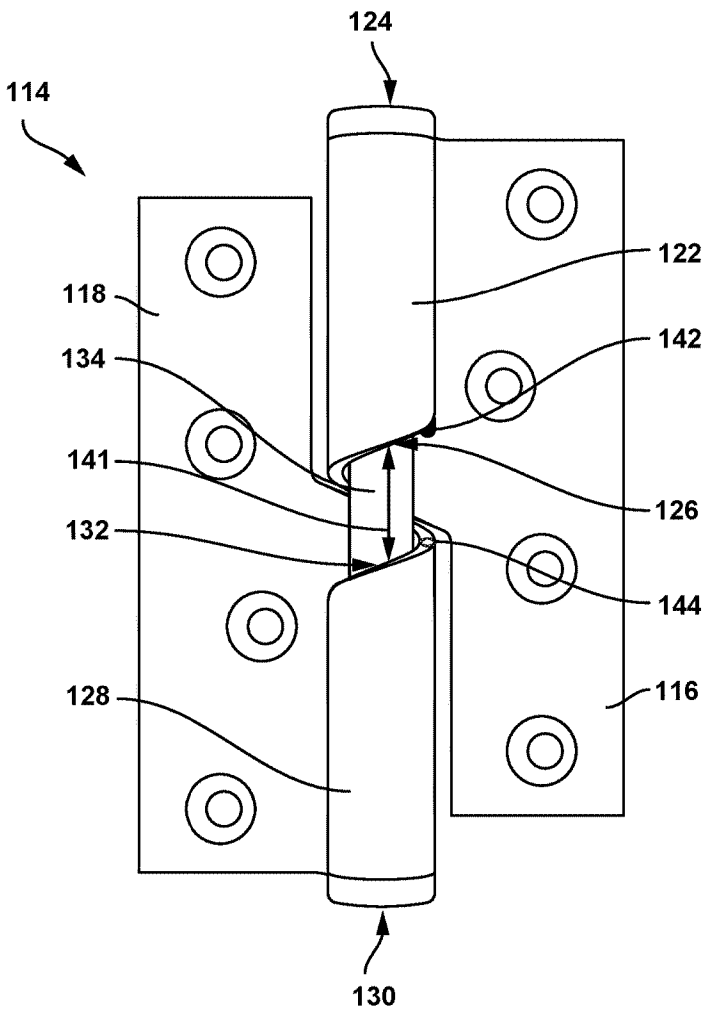
FIG. 3A illustrates an example hinge of the system of FIGS. 2A-2B.
Figure 3B:
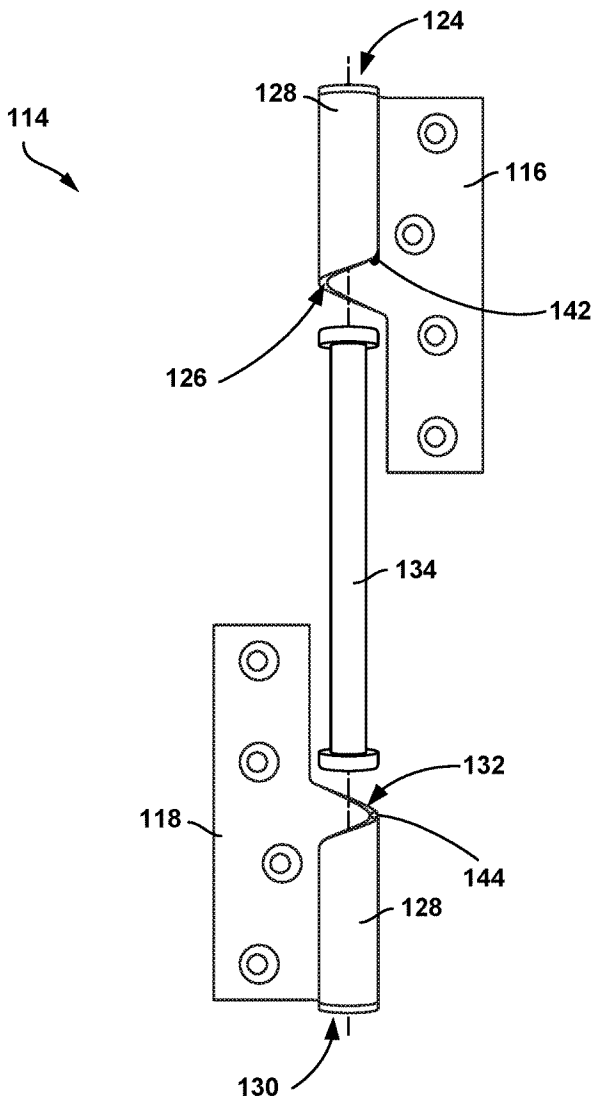
FIG. 3B illustrates an exploded view of the hinge of FIG. 3A.

FIG. 3A illustrates an example of a hinge 114 that can be used in the system 100 described above. FIG. 3B illustrates an exploded view of the hinge 114 of FIG. 3A. As shown in FIGS. 3A-3B, the hinge 114 includes a first plate 116 and a second plate 118 configured to rotate with respect to the first plate 116 as the hinge 114 rotates from a closed position to an open position. The hinge 114 also includes a first knuckle 122 coupled to the first plate 116. The first knuckle 122 includes a first through-hole 124, and the first knuckle 122 includes a first cam surface 126 having a slope greater than zero. The hinge 114 also includes a second knuckle 128 coupled to the second plate 118. The second knuckle 128 includes a second through-hole 130, and the second knuckle 128 includes a second cam surface 132. The second cam surface 132 of the second knuckle 128 is configured to contact the first cam surface 126 of the first knuckle 122. As discussed above, and as shown in FIGS. 3A-3B, the second cam surface 132 may have the same helical slope as the first cam surface 126. The hinge 114 further includes a pin 134 positioned through the first through-hole 124 of the first knuckle 122 and the second through-hole 130 of the second knuckle 128 to thereby rotatably couple the first knuckle 122 to the second knuckle 128. In use, a gap between the first cam surface 126 and the second cam surface 132 increases in response to a rotation of the hinge 114 from the closed position to the open position due to the helical slope of the first cam surface 126 and the second cam surface 132. The helical slope of the first cam surface 126 and the second cam surface 132 provides a self-closing feature to the door 102, as the weight of the door 102 causes the door 102 to move from the open position to the closed position in the absence of any additional force acting on the door 102.

As shown in FIGS. 3A-3B, the helical slope of the first cam surface 126 and the corresponding helical slope of the second cam surface 132 may be constant. In such an example, the change in height of the door 102 is constant as the door 102 rotates with respect to the stationary component 120. In one such example, the helical slope of the first cam surface 126 and the corresponding helical slope of the second cam surface 132 may be about 10°, about 15°, about 20°, or about 25°. Other helical slopes are possible as well.

As used herein, the helical slope of the first cam surface 126 and the corresponding helical slope of the second cam surface 132 may be calculated using the following equations, where, H is the amount of vertical change, D is the diameter of the helix of the first cam surface 126 and the second cam surface 132, rev is the decimal percent of one revolution, L is the arc length of the helix of the first cam surface 126 and the second cam surface 132, a is the helical slope in radians, and β is the helical slope in degrees.

$$L = (H^2 + \pi D)^{\frac{1}{2}} * rev \tag{1}$$

$$\alpha = \tan^{-1}\left(\frac{H}{L}\right) \tag{2}$$

$$\beta = \alpha * \frac{180}{\pi} \tag{3}$$

Further, as shown in FIGS. 3A-3B, the first cam surface 126 may include a first friction component 142, and the second cam surface 132 may include a second friction component 144 configured to interact with the first friction component 142 to stop the rotation of the door 102 between the closed position and the open position. Such an arrangement may allow a user to keep the door 102 in the open position without touching the door 102 when the second friction component 144 interacts with the first friction component 142.

In one example, as shown in FIGS. 3A-3B, the first friction component 142 comprises a protrusion, and the second friction component 144 comprises a notch complementary to the protrusion. In another example, the first friction component 142 comprises a notch, and the second friction component 144 comprises a protrusion complementary to the notch. In another example, the first friction component 142 comprises a plurality of teeth or ridges, and the second friction component 144 comprises a complementary plurality of teeth or ridges. Other example friction components are possible as well.

In one example, the first friction component 142 is configured to interact with the second friction component 144 at the maximum rotation of the door 102 with respect to the stationary component 120 (e.g., at about 270°). In another example, the first friction component 142 is configured to interact with the second friction component 144 prior to the maximum rotation of the door 102 with respect to the stationary component 120 (e.g., at about 90° or at about 180°). As such, a user can open the door 102 to a rotation greater than the location of the first friction component 142 and second friction component 144. In yet another example, the first cam surface 126 may include a plurality of friction components, and the second cam surface 132 may include a corresponding plurality of friction components configured to interact with the plurality of friction components on the first cam surface 126 to stop the rotation of the door 102 between the closed position and the open position. For example, the first cam surface 126 may include a friction component at about 90° rotation of the door 102 with respect to the stationary component 120, and another friction component at about 120°. In such an example, the second cam surface includes a complementary friction component at about 90° rotation of the door 102 with respect to the stationary component 120, and another friction component at about 120°. Additional friction components are possible as well.

Figure 4A:
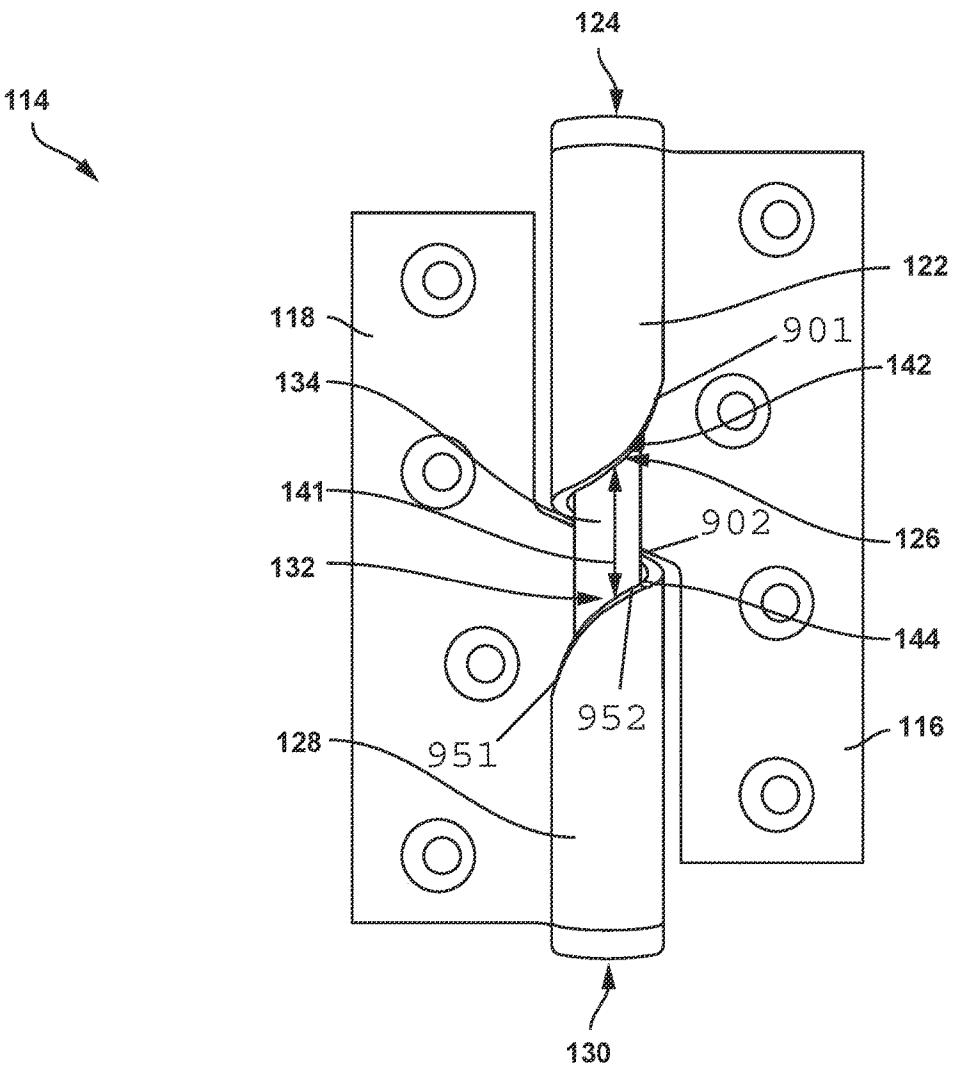
FIG. 4A illustrates another example hinge of the system of FIGS. 2A-2B.
Figure 4B:
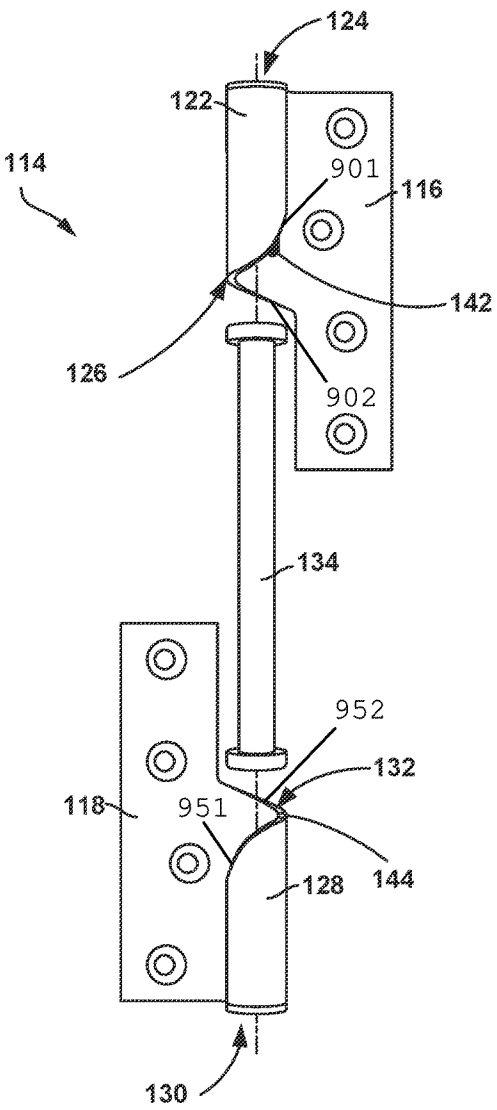
FIG. 4B illustrates an exploded view of the hinge of FIG. 4A.

FIG. 4A illustrates another example hinge 114 that can be used in the system 100 described above. FIG. 4B illustrates an exploded view of the hinge 114 of FIG. 4A. As shown in FIGS. 4A-4B, the hinge 114 may include all of the features of the hinge described in relation to FIGS. 3A-3B. However, the helical slope of the first cam surface 126 and the corresponding helical slope of the second cam surface 132 of the hinge 114 shown in FIGS. 4A-4B is non-constant. In such an example, the change in height of the door 102 is not constant as the door 102 rotates with respect to the stationary component 120. In one particular example, a first portion 901 of the first cam surface 126 and a corresponding first portion 951 of the second cam surface 132 has a first helical slope, and a second portion 902 of the first cam surface 126 and a corresponding second portion 952 of the second cam surface 132 has a second helical slope that is different than the first helical slope. In one such example, the first helical slope is greater than the second helical slope. The first helical slope may range from about 10° to about 25°, and the second helical slope may range from about 5° to about 15°, as non-limiting examples. Providing a greater helical slope for the initial rotation of the hinge 114 ensures that the seal 112 is lifted off of the floor surface 140 quickly to avoid dragging the seal 112 on the floor surface 140.

As shown in FIGS. 4A-4B, the first cam surface 126 may include a first friction component 142, and the second cam surface 132 may include a second friction component 144 configured to interact with the first friction component 142 to stop the rotation of the door 102 between the closed position and the open position. The first friction component 142 and the second friction component 144 may take a variety of forms, as discussed above in relation to FIGS. 3A-3B. Further, as discussed above, additional friction components may be added to the first cam surface 126 and the second cam surface 132 to provide multiple stops along the full rotation of the hinge 114.

In one example, a third portion 903 of the first cam surface 126 and a corresponding third portion 953 of the second cam surface 132 have a third helical slope that is different than the first helical slope and the second helical slope. In such an example, the second portion is positioned between the first portion and the third portion. The first helical slope may be greater than the second helical slope, and the second helical slope may be greater than the third helical slope. The first helical slope may range from about 10° to about 25°, the second helical slope may range from about 5° to about 15°, and the third helical slope may range from about 2.5° to about 15°, as non-limiting examples. In one particular example, first helical slope is about 14°, the second helical slope is about 10.5°, and the third helical slope is about 5.5°. Other slopes are possible as well. As discussed above, providing a greater helical slope for the initial rotation of the hinge 114 ensures that the seal 112 is lifted off of the floor surface 140 quickly to avoid dragging the seal 112 on the floor surface 140.

In yet another example, the third helical slope is a negative value compared to the first helical slope and the second helical slope. In such an example, the third helical slope causes the door 102 to be lowered to the floor surface 140 to transition the seal 112 from the relaxed state to the compressed state to thereby hold the door 102 in the open position due to the interaction between the floor surface 140 and the seal 112. The first helical slope may range from about 10° to about 25°, the second helical slope may range from about 5° to about 15°, and the third helical slope may range from about −10° to about −25°, as non-limiting examples. Other slopes are possible as well.

In another example, the first knuckle 122 and the second knuckle 128 of the hinge 114 may include multiple cam surfaces that interact with one another as the door 102 rotates between the closed position and the open position. This design may help to distribute the weight of the door 102 over multiple cam surfaces, and further distributes the wear of the hinge 114 over multiple surfaces, as opposed to just one. Such an embodiment may be applied to the hinges described and illustrated in FIGS. 3A-3B or FIGS. 4A-4B.

The system 100 described above, including the hinge 114 and other components, may be manufactured through a variety of techniques. In one particular non-limiting example, one or more components of the hinge 114 as shown in any one of FIGS. 1-4B is made via an additive manufacturing process using an additive-manufacturing machine, such as stereolithography, multi-jet modeling, inkjet printing, selective laser sintering/melting, and fused filament fabrication, among other possibilities. Additive manufacturing enables one or more components of the hinge 114 and other physical objects to be created as intraconnected single-piece structure through the use of a layer-upon-layer generation process. Additive manufacturing involves depositing a physical object in one or more selected materials based on a design of the object. For example, additive manufacturing can generate one or more components of the hinge 114 using a Computer Aided Design (CAD) of the hinge 114 as instructions. As a result, changes to the design of the hinge 114 can be immediately carried out in subsequent physical creations of the hinge 114. This enables the components of the hinge 114 to be easily adjusted or scaled to fit different types of applications (e.g., for use in various compartment sealing doors).

The layer-upon-layer process utilized in additive manufacturing can deposit one or more components of the hinge 114 with complex designs that might not be possible for devices assembled with traditional manufacturing. In turn, the design of the hinge 114 can include aspects that aim to improve overall operation. For example, the design can incorporate physical elements that help redirect stresses in a desired manner that traditionally manufactured devices might not be able to replicate.

Additive manufacturing also enables depositing one or more components of the hinge 114 in a variety of materials using a multi-material additive-manufacturing process. In such an example, the pin 134 may be made from a first material and the first plates 116 and the second plates 118 as well as the first knuckle 122 and the second knuckle 128 may be made from a second material that is different than the first material. In one particular example, the first material comprises stainless steel, titanium, nickel super-alloy, or aluminum, and the second material comprises polyether ether ketone (PEEK), polyethylene (PE), or polypropylene (PP), as non-limiting examples. In another example, all components of the hinge 114 are made from the same material. Other example material combinations are possible as well. Further, one or more components of the hinge 114 can have some layers that are created using a first type of material and other layers that are created using a second type of material. In addition, various processes are used in other examples to produce one or more components of the hinge 114. These processes are included in table 1 below.

TABLE 1

| | |
|---|---|
| DEP | Direct Energy Deposition |
| DMLS | Direct Metal Laser Sintering |

TABLE 1-continued

| | |
|---|---|
| DMP | Direct Metal Printing |
| EBAM | Electron Beam Additive Manufacturing |
| EBM | Electron Beam Leting |
| EBPD | Electron Beam Powder Bed |
| FDM | Fused Deposition Modeling |
| IPD | Indirect Power Bed |
| LCT | Laser Cladding Technology |
| LDT | Laser Deposition Technology |
| LDW | Laser Deposition Welding |
| LDWM | Laser Deposition Welding with integrated Milling |
| LENS | Laser Engineering Net Shape |
| LFMT | Laser Freeform Manufacturing Technology |
| LMD-p | Laser Metal Deposition-powder |
| LMD-w | Laser Metal Deposition-wire |
| LPB | Laser Powder Bed |
| LPD | Laser Puddle Deposition |
| LRT | Laser Repair Technology |
| PDED | Powder Directed Energy Deposition |
| SLA | Stereolithography |
| SLM | Selective Laser Melting |
| SLS | Selective Laser Sintering |
| SPD | Small Puddle Deposition |

In some example implementations, one or more components of the hinge 114 are generated using melt-away support materials, such as sulfone, thermoplastic, polyester, organic composite photoresist materials, and dry film resists. Particularly, during the layer-upon-layer generation process, a melt-away support material can support one or more components of the hinge 114 until the one or more components of the hinge 114 is complete and stable enough to standalone. In turn, the melt-away support material can support physical aspects of the hinge 114 during the layer-upon-layer generation process until the hinge 114 is completed. After the one or more components of the hinge 114 are completed, the melt-away support material can be removed to leave only the finished components remaining. For instance, a water soluble melt-away support material can rinse away from portions of hinge 114.

Figure 5:
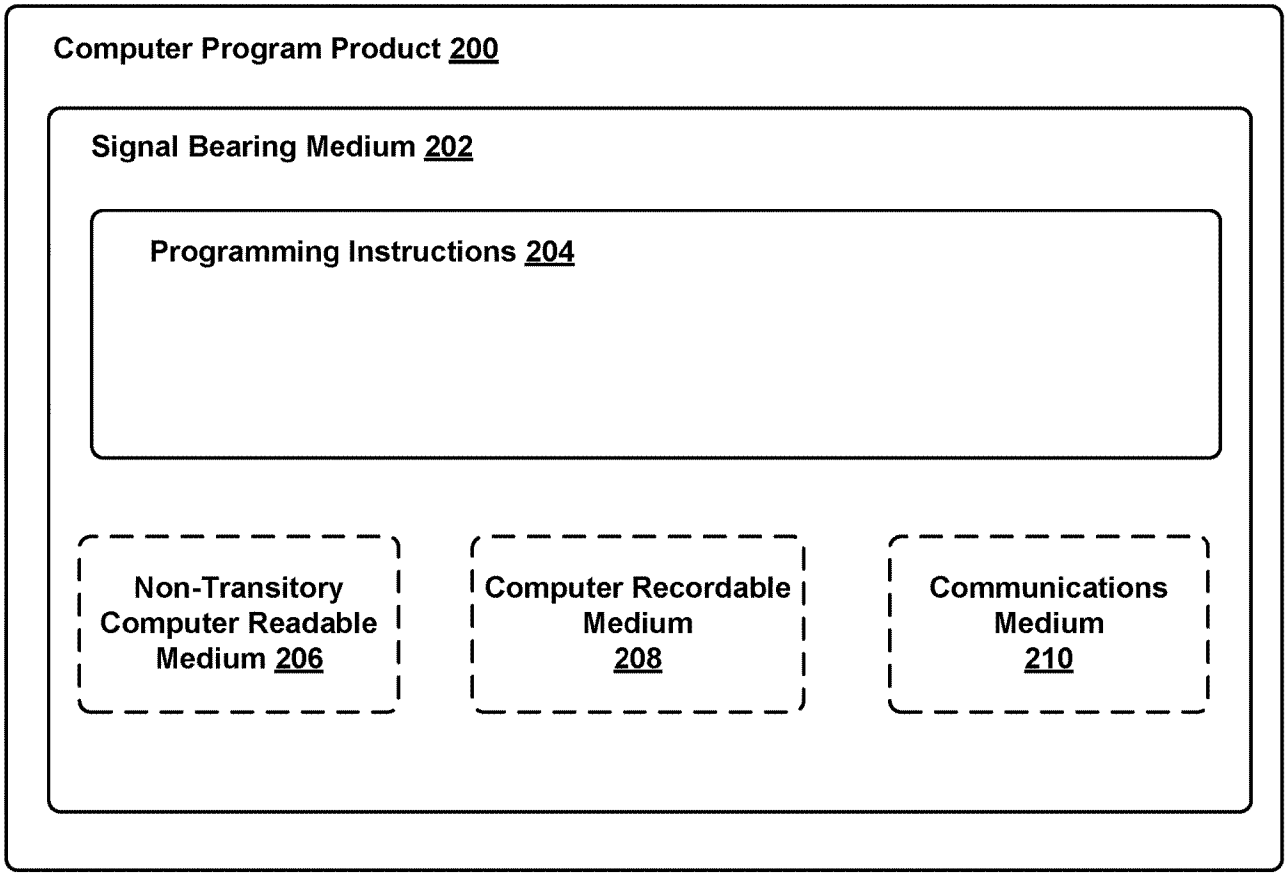
FIG. 5 is an example computer-readable medium configured according to an example implementation to cause an additive manufacturing machine to create one or more components of the hinge of FIGS. 1-4B.

The additive-manufacturing machines and/or processes described above may be controlled by non-transitory computer-readable medium. FIG. 5 depicts an example non-transitory computer-readable medium configured according to an example implementation. In example implementations, the system may include one or more processors, one or more forms of memory, one or more input devices/interfaces, one or more output devices/interfaces, and machine readable instructions that, when executed by the one or more processors, cause an additive manufacturing machine to create one or more components of the hinge 114 of any of the examples described above with respect to FIGS. 1-4B.

In one implementation, the example computer program product 200 is provided using a signal bearing medium 202. The signal bearing medium 202 may include one or more programming instructions 204 that, when executed by one or more processors may cause an additive manufacturing machine to create one or more components of the hinge 114 of any of the embodiments described above with respect to FIGS. 1-4B. In some examples, the signal bearing medium 202 may be a non-transitory computer-readable medium 206, such as, but not limited to, a hard disk drive, a Compact Disc (CD), a Digital Video Disk (DVD), a digital tape, memory, etc. In some implementations, the signal bearing medium 202 may be a computer recordable medium 208, such as, but not limited to, memory, read/write (R/W) CDs, R/W DVDs, etc. In some implementations, the signal bearing medium 202 may be a communications medium 210 (e.g., a fiber optic cable, a waveguide, a wired communications link, etc.). Thus, for example, the signal bearing medium 202 may be conveyed by a wireless form of the communications medium 210.

The one or more programming instructions 204 may be, for example, computer executable and/or logic implemented instructions. In some examples, a computing device may be configured to provide various operations, functions, or actions in response to the programming instructions 204 conveyed to the computing device by one or more of the non-transitory computer-readable medium 206, the computer recordable medium 208, and/or the communications medium 210.

The non-transitory computer-readable medium 206 may also be distributed among multiple data storage elements, which could be remotely located from each other. The computing device that executes some or all of the stored instructions could be an external computer, or a mobile computing platform, such as a smartphone, tablet device, personal computer, wearable device, etc. Alternatively, the computing device that executes some or all of the stored instructions could be a remotely located computer system, such as a server.

Figure 6:
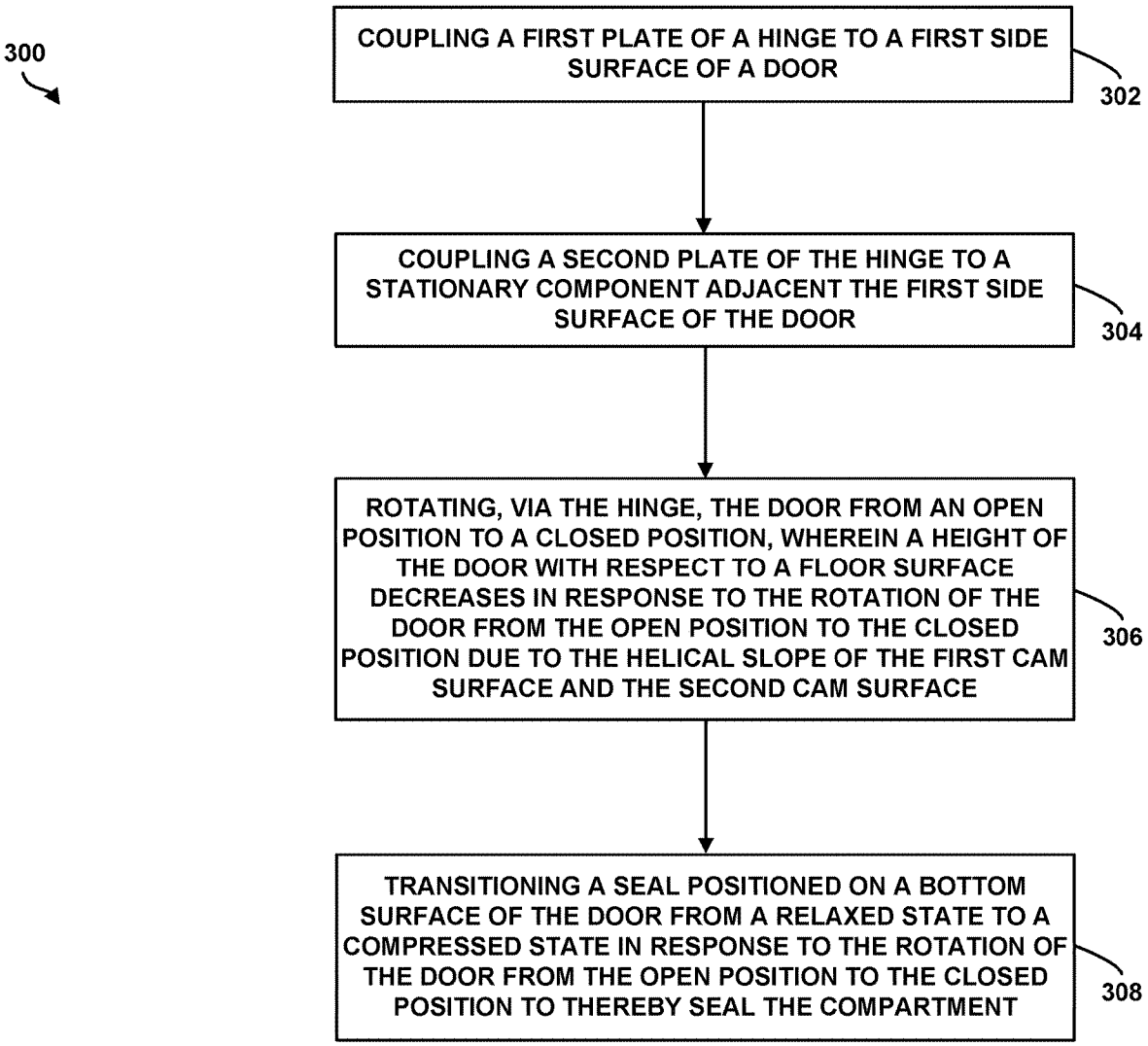
FIG. 6 is a flowchart of a method for sealing a compartment using the system of FIGS. 1-4B.

FIG. 6 is a block diagram of an example of a method 300 for sealing a compartment. Method 300 shown in FIG. 6 presents an embodiment of a method that could be carried out using the system 100 of FIGS. 1-4B, as an example. Method 300 includes one or more operations, functions, or actions as illustrated by one or more of blocks 302-308. Although the blocks are illustrated in a sequential order, these blocks may also be performed in parallel, and/or in a different order than those described herein. Also, the various blocks may be combined into fewer blocks, divided into additional blocks, and/or removed based upon the desired implementation.

Initially, at block 302, the method 300 includes coupling a first plate 116 of a hinge 114 to a first side surface 108 of a door 102. In one example, the first plate 116 is coupled to the first side surface 108 of the door 102 via a plurality of screws. In another example, the first plate 116 is coupled to the first side surface 108 of the door 102 via an adhesive. Other coupling mechanisms are possible as well. At block 304, the method 300 includes coupling a second plate 118 of the hinge 114 to a stationary component 120 adjacent the first side surface 180 of the door 102. The hinge 114 comprises the hinge 114 of any of the embodiments described above with respect to FIGS. 1-4B. In one example, the second plate 118 is coupled to the stationary component 120 via a plurality of screws. In another example, the second plate 118 is coupled to the stationary component 120 via an adhesive. Other coupling mechanisms are possible as well. At block 306, the method 300 includes rotating, via the hinge 114, the door 102 from an open position to a closed position, wherein a height of the door 102 with respect to a floor surface 140 decreases in response to the rotation of the door 102 from the open position to the closed position due to the helical slope of the first cam surface 126 and the second cam surface 132 of the hinge 114. At block 308, the method 300 transitioning a seal 112 positioned on a bottom surface 106 of the door 102 from a relaxed state to a compressed state in response to the rotation of the door 102 from the open position to the closed position to thereby seal the compartment 101.

In one example, the method 300 further includes rotating the door 102 from the closed position to the open position, where the height of the door 102 with respect to the floor surface 140 increases in response to the rotation of the door 102 from the closed position to the open position due to the helical slope of the first cam surface 126 and the second cam surface 132 of the hinge 114. In yet another example, the method 300 further includes maintaining the door 102 in the open position via an interaction between a first friction component 142 of the first cam surface 126 and a second friction component 144 of the second cam surface 132.

In the above description, numerous specific details are set forth to provide a thorough understanding of the disclosed concepts, which may be practiced without some or all of these particulars. In other instances, details of known devices and/or processes have been omitted to avoid unnecessarily obscuring the disclosure. While some concepts were described in conjunction with specific examples, it will be understood that these examples are not intended to be limiting.

In FIG. 1, solid lines, if any, connecting various elements and/or components may represent mechanical, electrical, fluid, optical, electromagnetic and other couplings and/or combinations thereof. As used herein, "coupled" means associated directly as well as indirectly. For example, a member A may be directly associated with a member B, or may be indirectly associated therewith, e.g., via another member C. It will be understood that not all relationships among the various disclosed elements are necessarily represented. Accordingly, couplings other than those depicted in the block diagrams may also exist. Dashed lines, if any, connecting blocks designating the various elements and/or components represent couplings similar in function and purpose to those represented by solid lines; however, couplings represented by the dashed lines may either be selectively provided or may relate to alternative examples of the present disclosure. Likewise, elements and/or components, if any, represented with dashed lines, indicate alternative examples of the present disclosure. One or more elements shown in solid and/or dashed lines may be omitted from a particular example without departing from the scope of the present disclosure. Environmental elements, if any, are represented with dotted lines. Virtual (imaginary) elements may also be shown for clarity. Those skilled in the art will appreciate that some of the features illustrated in FIG. 1 may be combined in various ways without the need to include other features described in FIG. 1, other drawing figures, and/or the accompanying disclosure, even though such combination or combinations are not explicitly illustrated herein. Similarly, additional features not limited to the examples presented, may be combined with some or all of the features shown and described herein.

In FIG. 6, referred to above, the blocks may represent operations and/or portions thereof and lines connecting the various blocks do not imply any particular order or dependency of the operations or portions thereof. It will be understood that not all dependencies among the various disclosed operations are necessarily represented. FIG. 6 and the accompanying disclosure describing the operations of the method(s) set forth herein should not be interpreted as necessarily determining a sequence in which the operations are to be performed. Rather, although one illustrative order is indicated, it is to be understood that the sequence of the operations may be modified when appropriate. Accordingly, certain operations may be performed in a different order or simultaneously. Additionally, those skilled in the art will appreciate that not all operations described need be performed.

Figure 7:
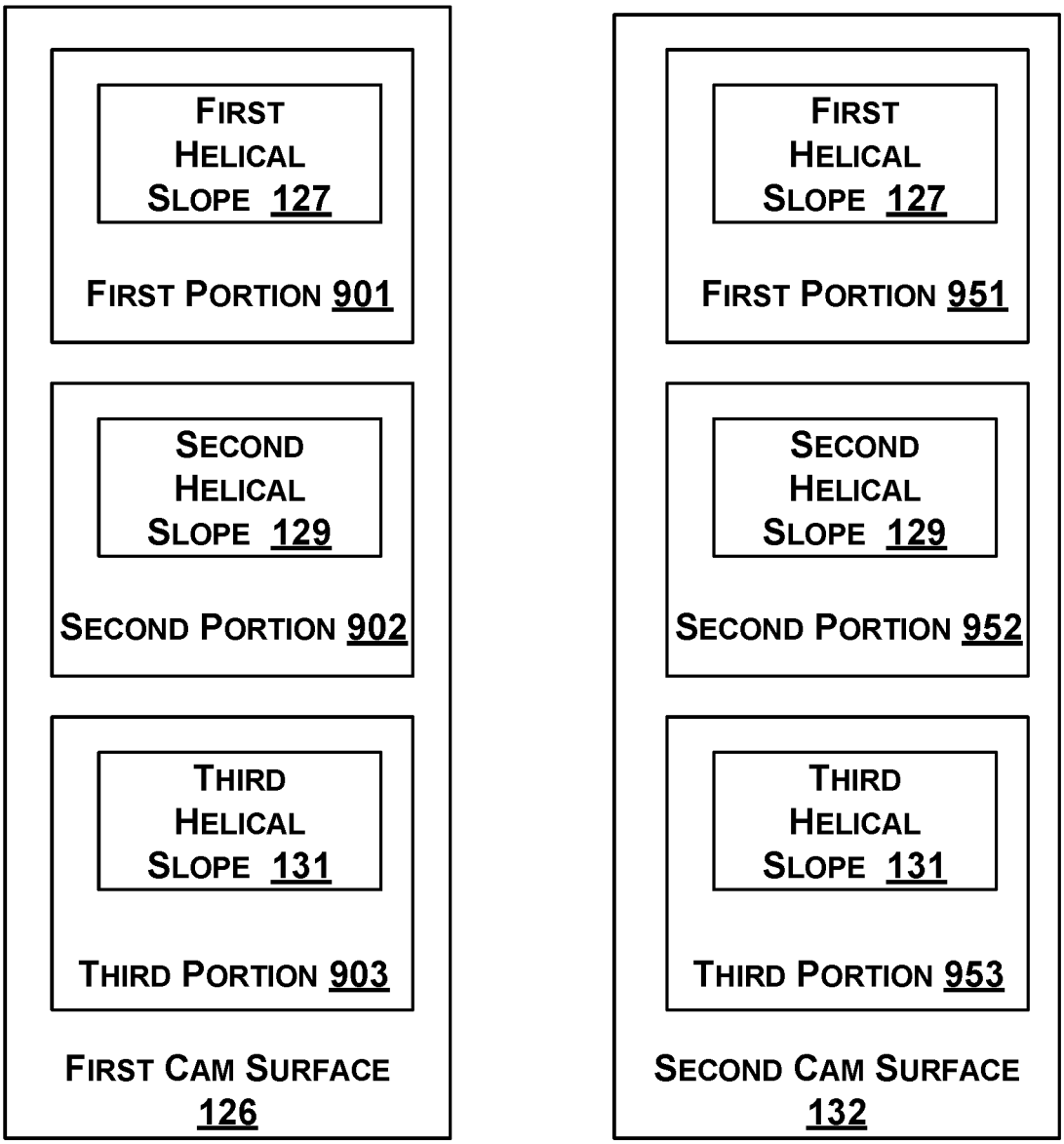
FIG. 7 is a block diagram of example cam surfaces.

FIG. 7 is a block diagram of the first cam surface 126 and the second cam surface 132. The first cam surface 126 includes the first portion 901 having the first helical slope 127, the second portion 902 having the second helical slope 129, and the third portion 903 having the third helical slope 131. The second cam surface 132 includes the first portion 951 having the first helical slope 127, the second portion 952 having the second helical slope 129, and the third portion 953 having the third helical slope 131.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

Reference herein to "one example" means that one or more feature, structure, or characteristic described in connection with the example is included in at least one implementation. The phrase "one example" in various places in the specification may or may not be referring to the same example.

As used herein, a system, apparatus, device, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

As used herein, with respect to measurements, "about" and "substantially" each means+/−5%.

The description of the different advantageous arrangements has been presented for purposes of illustration and description, and is not intended to be exhaustive or limited to the examples in the form disclosed. Many modifications and variations will be apparent to those of ordinary skill in the art. Further, different advantageous examples may provide different advantages as compared to other advantageous examples. The example or examples selected are chosen and described in order to best explain the principles of the examples, the practical application, and to enable others of ordinary skill in the art to understand the disclosure for various examples with various modifications as are suited to the particular use contemplated.

What is claimed is:

1. A system for sealing a compartment, the system comprising:

a door having a top surface, a bottom surface opposite the top surface, a first side surface, and a second side surface opposite the first side surface;

a seal positioned on the bottom surface of the door; and one or more hinges coupled to the door, wherein each of the one or more hinges comprises:

a first plate coupled to the first side surface of the door;

a second plate configured to be coupled to a stationary component adjacent the first side surface of the door such that the first plate is configured to rotate with respect to the second plate as the door rotates from a closed position to an open position;

a first knuckle coupled to the first plate, wherein the first knuckle includes a first through-hole, and wherein the first knuckle includes a first helical cam surface having a first portion having a first helical slope and a second portion having a second helical slope that is different from the first helical slope;

a second knuckle coupled to the second plate, wherein the second knuckle includes a second through-hole, and wherein the second knuckle includes a second helical cam surface having a first portion having the first helical slope and a second portion having the second helical slope, and wherein the second helical cam surface of the second knuckle is configured to contact the first helical cam surface of the first knuckle; and a pin positioned through the first through-hole of the first knuckle and the second through-hole of the second knuckle to thereby rotatably couple the first knuckle to the second knuckle, wherein a height of the door with respect to a floor surface increases at a first rate with respect to a first rotation of the door from the closed position to an intermediate position as the first portion of the first helical cam surface moves against the first portion of the second helical cam surface, wherein the height of the door with respect to the floor surface increases at a second rate with respect to a second rotation of the door from the intermediate position toward the open position as the second portion of the first helical cam surface moves against the second portion of the second helical cam surface, wherein the first rate is greater than the second rate, and wherein the seal transitions from a compressed state to a relaxed state in response to rotation of the door from the closed position to the open position.

2. The system of claim 1, wherein a height of the seal is greater in the relaxed state than in the compressed state.

3. The system of claim 1, wherein a maximum rotation of the door with respect to the stationary component is about 270°.

4. The system of claim 1, wherein the first helical slope is greater than the second helical slope.

5. The system of claim 1, wherein a third portion of the first helical cam surface and a corresponding third portion of the second helical cam surface each have a third helical slope that is different than the first helical slope and the second helical slope, and wherein the second portion is positioned between the first portion and the third portion on both the first helical cam surface and the second helical cam surface.

6. The system of claim 5, wherein the first helical slope is greater than the second helical slope, and wherein the second helical slope is greater than the third helical slope.

7. The system of claim 5, wherein the first helical slope is greater than the second helical slope, wherein the third helical slope is a negative value compared to the first helical slope and the second helical slope, and wherein the third helical slope causes the door to be lowered to the floor surface to transition the seal from the relaxed state to the compressed state to thereby hold the door in the closed position.

8. A system for sealing a compartment, the system comprising:

a door having a top surface, a bottom surface opposite the top surface, a first side surface, and a second side surface opposite the first side surface;

a seal positioned on the bottom surface of the door; and one or more hinges coupled to the door, wherein each of the one or more hinges comprises:

a first plate coupled to the first side surface of the door;

a second plate configured to be coupled to a stationary component adjacent the first side surface of the door such that the first plate is configured to rotate with respect to the second plate as the door rotates from a closed position to an open position;

a first knuckle coupled to the first plate, wherein the first knuckle includes a first through-hole, and wherein the first knuckle includes a first helical cam surface having a first portion having a first helical slope and a second portion having a second helical slope that is different from the first helical slope;

a second knuckle coupled to the second plate, wherein the second knuckle includes a second through-hole, and wherein the second knuckle includes a second helical cam surface having a first portion having the first helical slope and a second portion having the second helical slope, and wherein the second helical cam surface of the second knuckle is configured to contact the first helical cam surface of the first knuckle; and a pin positioned through the first through-hole of the first knuckle and the second through-hole of the second knuckle to thereby rotatably couple the first knuckle to the second knuckle, wherein a height of the door with respect to a floor surface increases in response to a rotation of the door from the closed position to the open position, and wherein the seal transitions from a compressed state to a relaxed state in response to the rotation of the door from the closed position to the open position, wherein the first helical cam surface includes a first friction component with a remaining portion of the first helical cam surface being smooth, and wherein the second helical cam surface includes a second friction component with a remaining portion of the second helical cam surface being smooth, wherein the second friction component is configured to interact with the first friction component to stop the rotation of the door between the closed position and the open position.

9. A hinge comprising:

a first plate;

a second plate configured to rotate with respect to the first plate as the hinge rotates from a closed position to an open position;

a first knuckle coupled to the first plate, wherein the first knuckle includes a first through-hole, and wherein the first knuckle includes a first helical cam surface having a first portion having a first helical slope and a second portion having a second helical slope that is different from the first helical slope;

a second knuckle coupled to the second plate, wherein the second knuckle includes a second through-hole, and wherein the second knuckle includes a second helical cam surface having a first portion having the first helical slope and a second portion having the second helical slope, and wherein the second helical cam surface of the second knuckle is configured to contact the first helical cam surface of the first knuckle; and a pin positioned through the first through-hole of the first knuckle and the second through-hole of the second knuckle to thereby rotatably couple the first knuckle to the second knuckle, wherein a gap between the first helical cam surface and the second helical cam surface increases at a first rate with respect to a first rotation of the hinge from the closed position to an intermediate position as the first portion of the first helical cam surface moves against the first portion of the second helical cam surface, and wherein the gap between the first helical cam surface and the second helical cam surface increases at a second rate with respect to a second rotation of the hinge from the intermediate position toward the open position as the second portion of the first helical cam surface moves against the second portion of the second helical cam surface, wherein the first rate is greater than the second rate.

10. The hinge of claim 9, wherein the first helical slope is greater than the second helical slope.

11. The hinge of claim 9, wherein a third portion of the first helical cam surface and a corresponding third portion of the second helical cam surface each have a third helical slope that is different than the first helical slope and the second helical slope, and wherein the second portion is positioned between the first portion and the third portion on both the first helical cam surface and the second helical cam surface.

12. The hinge of claim 11, wherein the first helical slope is greater than the second helical slope, and wherein the second helical slope is greater than the third helical slope.

13. The hinge of claim 9, wherein the first helical cam surface includes a first friction component with a remaining portion of the first helical cam surface being smooth, and wherein the second helical cam surface includes a second friction component with a remaining portion of the second helical cam surface being smooth, wherein the second friction component is configured to interact with the first friction component to stop rotation of the hinge between the closed position and the open position.

14. A method for sealing a compartment, the method comprising:

coupling a first plate of a hinge to a first side surface of a door;

coupling a second plate of the hinge to a stationary component adjacent the first side surface of the door, wherein the hinge further includes (i) a first knuckle coupled to the first plate, wherein the first knuckle includes a first helical cam surface having a first portion having a first helical slope and a second portion having a second helical slope that is different from the first helical slope, and (ii) a second knuckle coupled to the second plate, wherein the second knuckle includes a second helical cam surface having a first portion having the first helical slope and a second portion having the second helical slope, and wherein the second helical cam surface of the second knuckle is configured to contact the first helical cam surface of the first knuckle;

performing a first rotation of the door via the hinge from an open position to an intermediate position, wherein a height of the door with respect to a floor surface decreases at a first rate with respect to the first rotation of the door as the second portion of the first helical cam surface moves against the second portion of the second helical cam surface;

performing a second rotation of the door via the hinge from the intermediate position to a closed position, wherein the height of the door with respect to the floor surface decreases at a second rate with respect to the second rotation of the door as the first portion of the first helical cam surface moves against the first portion of the second helical cam surface, wherein the first rate is less than the second rate; and transitioning a seal positioned on a bottom surface of the door from a relaxed state to a compressed state in response to the rotation of the door from the open position to the closed position to thereby seal the compartment.

15. The method of claim 14, further comprising:

rotating the door from the closed position to the open position, wherein the height of the door with respect to the floor surface increases in response to the rotation of the door from the closed position to the open position.

16. The method of claim 15, further comprising:

maintaining the door in an intermediate position between the open position and the closed position via an interaction between a first friction component of the first helical cam surface and a second friction component of the second helical cam surface, wherein a remaining portion of the first helical cam surface is smooth and a remaining portion of the second helical cam surface is smooth.

17. The method of claim 15, wherein rotating the door from the closed position to the open position comprises rotating the door 270° with respect to the stationary component.

18. The method of claim 14, wherein a third portion of the first helical cam surface and a corresponding third portion of the second helical cam surface each have a third helical slope that is different than the first helical slope and the second helical slope, and wherein the second portion is positioned between the first portion and the third portion on both the first helical cam surface and the second helical cam surface.

19. The method of claim 18, wherein the first helical slope is greater than the second helical slope, and wherein the second helical slope is greater than the third helical slope.

20. The method of claim 14, wherein the first helical slope is greater than the second helical slope.

* * * * *